US005454933A

United States Patent [19]

Savage et al.

[11] Patent Number: 5,454,933

[45] Date of Patent: Oct. 3, 1995

[54] DEEP DESULFURIZATION OF DISTILLATE FUELS

[75] Inventors: David W. Savage, Lebanon; Bal K. Kaul, Randolph; Gerald D. Dupre, Flemington; Joseph T. O'Bara, Parsippany; William E. Wales, Phillipsburg; Teh C. Ho, Bridgewater, all of N.J.

[73] Assignee: Exxon Research and Engineering Company, Florham Park, N.J.

[21] Appl. No.: 809,629

[22] Filed: Dec. 16, 1991

[51] Int. Cl.[6] ..... C10G 45/00

[52] U.S. Cl. ..... 208/212; 208/213; 208/299; 208/301; 208/305; 208/307

[58] Field of Search ..... 208/212, 213, 208/299, 301, 305, 307, 310 R, 310 Z, 99

[56] References Cited

U.S. PATENT DOCUMENTS

| | | | |
|---|---|---|---|
| 2,847,485 | 8/1958 | Van Dyck Fear | 208/305 |
| 2,877,176 | 3/1959 | Wolff et al. | 208/307 |
| 4,179,361 | 12/1979 | Michlmayr | 208/244 |
| 4,337,156 | 6/1982 | deRosset | 210/672 |
| 4,714,539 | 12/1987 | Moser et al. | 208/139 |
| 4,719,007 | 1/1988 | Johnson et al. | 208/251 H |

*Primary Examiner*—Anthony McFarlane
*Assistant Examiner*—Walter C. Griffin
*Attorney, Agent, or Firm*—Henry E. Naylor

[57] ABSTRACT

A process for providing distillate products which are substantially sulfur free, which process comprises subjecting a distillate stream to conventional hydrodesulfurization conditions including a catalyst comprised of a Group VI metal and at least one Group VIII metal on a refractory support. The hydrodesulfurized stream is then treated with a solid adsorbent material capable of adsorbing beta and di-beta-substituted dibenzothiophene sulfur compounds.

3 Claims, 6 Drawing Sheets

DEEP DESULFURIZATION OF DISTILLATE FUELS

FIELD OF THE INVENTION

The present invention relates to the production of distillate fuels which are substantially free of sulfur. The distillate stream is first conventionally hydrotreated to remove the so-called "easy sulfur." The hydrotreated distillate stream, which still contains an undesirable amount of sulfur which is difficult to remove (so-called "hard-sulfur"), is contacted with a solid adsorbent capable of removing the remaining sulfur, thereby resulting in a distillate product which is substantially free of sulfur.

BACKGROUND OF THE INVENTION

The production of clean distillate products, such as diesel fuels, is becoming more and more important in petroleum processing. This is primarily because governmental regulations are placing ever stricter limits on the amounts of heteroatoms, such as sulfur, as well as other pollutant precursors, which can be present in such products. Conventional hydrotreating processes for removing sulfur from distillates are generally only capable of removing the so-called "easy sulfur" —not the so-called "hard sulfur." "Easy sulfurs" include non-thiophenic sulfur, thiophenes, benzothiophenes, and non-beta-substituted dibenzothiophenes. "Hard sulfurs" include beta-substituted dibenzothiophenes and, in particular, di-beta-substituted dibenzothiophenes. The hard sulfur, which remains after removal of the easy sulfur by conventional hydrodesulfurization, can represent a significant undesirable amount. This amount can be in the range of about 0.2 to 0.3 wt. %, or more of the diesel fraction. In order to meet new governmental regulations, this hard sulfur will also have to be removed from distillate product streams, preferably by the most economic means.

One approach which can be taken to remove hard sulfur is to build new high pressure hydrotreating facilities. While this approach will work from a technology point of view, it is expensive and not cost effective at today's distillate prices. Consequently, there is a critical need in the art for economical methods for removing hard sulfur from distillate product streams in order for these product streams to meet the new regulations.

SUMMARY OF THE INVENTION

In accordance with the present invention, there is provided a process for removing substantially all of the sulfur from a sulfur-containing distillate stream, which process comprises:

(a) hydrotreating the stream at conditions which include the presence of hydrogen, temperatures within the range of 200° to 400° C., and a catalyst comprised of at least one Group VIII metal and one Group VI metal, on an inorganic support;

(b) passing the hydrotreated distillate stream to an adsorption zone containing a solid adsorbent capable of adsorbing beta and di-beta-substituted dibenzothiophene aromatic sulfur compounds;

(c) collecting the resulting substantially sulfur free distillate stream; and (d) regenerating the adsorbent by passing a liquid or vapor desorbent through the bed of adsorbent in the adsorption zone, thereby removing the beta and di-beta-substituted dibenzothiophene sulfur compounds from the adsorbent;

(e) passing the beta and di-beta-substituted dibenzothiophene sulfur compound-containing desorbent to a distillation zone to separate said sulfur compounds from the desorbent, thereby resulting in a stream rich in beta and di-beta-substituted dibenzothiophene sulfur compounds and a desorbent stream; and (f) recycling the desorbent stream back to the adsorption zone.

In preferred embodiments of the present invention, the adsorbent is selected from silica gel, activated alumina, zeolites, supported CoMo sorbents, activated coke, and activated carbon, and the distillate stream is a diesel fuel.

In another preferred embodiment, the solid adsorbent is desorbed of di-beta-substituted dibenzothiophene sulfur compounds by use of an organic solvent having an affinity for the sulfur compounds and having a boiling point at least 10° F. different than the average boiling point of the 3-ring sulfur compounds.

DETAILED DESCRIPTION OF THE INVENTION

Streams which are treated in accordance with the present invention are distillate process streams resulting from the refining of hydrocarbonaceous chargestocks. Such distillate streams are typically those boiling in the range of about 175° to 400° C. and are often referred to as middle distillates, or light gas oils and include the so-called diesel fuels. Non-limiting examples of distillate fuels include kerosene, jet fuel, light diesel oil, heating oil, and heavy diesel oil.

Figure 1:
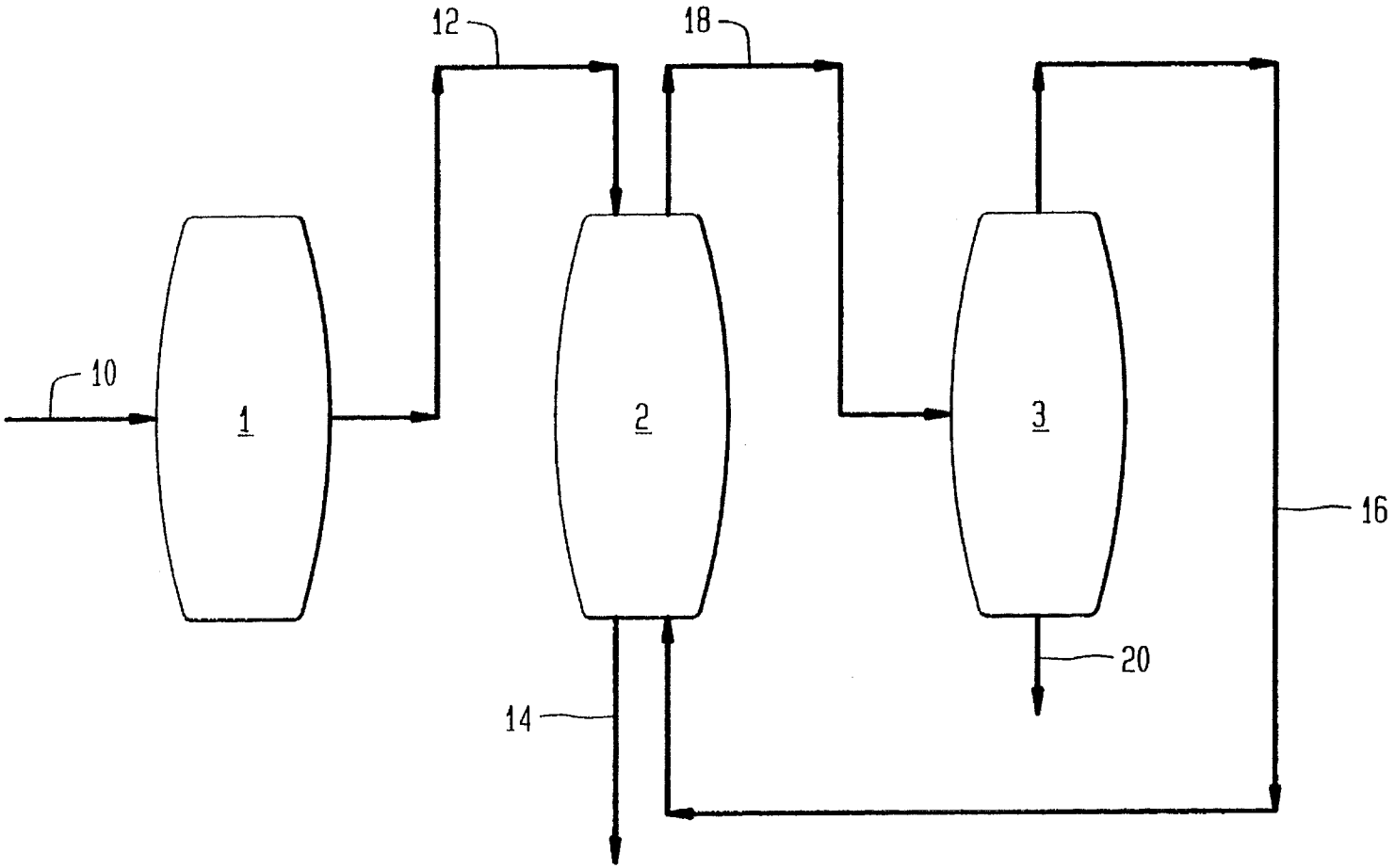
FIG. 1 is a simplified flow scheme of a preferred embodiment of the present invention.

Turning now to FIG. 1, a simplified flow scheme is shown for the practice of the present invention wherein a distillate stream is fed via line 10 to hydrotreating zone 1. The hydrotreating is conducted at conventional hydrotreating conditions which include temperatures from about 200° to 425° C., preferably from about 300° C. to 75° C.; pressures from about 250 to 1500 psig; preferably from about 500 to 1200 psig; liquid hourly space velocities from about 0.05 to 6 V/V/Hr; and a hydrogen gas rate of about 500 to 6000 SCF/B; where SCF/B means standard cubic feet per barrel, and V/V/Hr means volume of fuel per volume of the reactor vessel per hour.

Any hydrodesulfurization catalyst may be used in hydrotreating zone 1. Conventional catalysts are typically comprised of a Group VI metal with one or more Group VIII metals as promoters, on a refractory support. It is preferred that the Group VI metal be molybdenum or tungsten, more preferably molybdenum. Cobalt is the preferred Group VIII metal with alumina being the preferred support. The Group VIII metal is present in an amount ranging from about 2 to 20 wt. %, preferably from about 4 to 12 wt. %. The Group VI metal is present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weight 100 g., then 20 wt. % Group VIII metal would mean that 20 g. of Group VIII metal was on the support. Any suitable refractory support can be used. Such supports are preferably inorganic oxides, such as alumina, silica, silica-alumina, titania, and the like.

The distillate stream, after hydrotreating, will contain substantially less sulfur, but still too much to meet the ever stricter environmental requirements. That is, substantially all of the easy sulfur will have been removed, leaving only the hard sulfur, which is typically present as beta and di-beta-substituted dibenzothiophene compounds which are 3-ring sulfur compounds. The hydrotreated stream is then fed via line 12 into adsorption zone 2. Adsorption zone 2 contains solid adsorbent capable of selectively adsorbing sulfur compounds, even the 3-ring hard sulfur compounds from other components of the stream, such as non-sulfur aromatics and saturates. Materials suitable for use as adsorbents in the practice of the present invention are porous inert materials having pores large enough to adsorb the beta and di-beta-substituted dibenzothiophene compounds of the feed. Non-limiting examples of such adsorbents include silica gel, activated alumina, zeolites, supported CoMo sorbents, activated coke, and activated carbons. Preferred is activated carbon and activated coke.

Preferred activated carbons are typically large-pore carbons which may be prepared from coal and other materials by carbonization and treatment with oxidizing and other gases to develop the pore system. Surface area, as measured by the nitrogen BET, is usually in the range 800–1200 $m^2/g$, with a high fraction of the pores in the 20 Å–100 Å range. Preferred activated cokes are similar in that they should have high surface area, large-pore carbonaceous structures prepared from petroleum residuum, bitumen or pitch.

The adsorption zone, is operated at any suitable set of conditions, preferably including the temperature of the distillate stream, which will typically be from about ambient temperature (20° C.) to about 175° C. The adsorption zone can be comprised of only one adsorption vessel, or two separate vessels. It can also be comprised of three or more vessels with the appropriate plumbing for regeneration of the adsorbent. The adsorption vessels can be either moving or fixed bed vessels. The product stream, which leaves the adsorption zone via line 14 is substantially free of all sulfur compounds, even the so-called "hard sulfur."

The solid adsorbent is regenerated by treating it with a suitable desorbent. Suitable desorbents include organic solvents, both aromatic and non-aromatic, which have a boiling point different than the polynuclear aromatic sulfur compounds adsorbed on the adsorbent. The difference in boiling point should be at least about 5° C., preferably at least about 10° C. Preferred desorbents are aromatic solvents, more preferred are toluene and xylene, and most preferred is toluene. It is also to be understood that refinery streams having substantial concentrations of such organic solvents can also be used. The desorbent enters the adsorption zone via line 16 where it contacts the adsorbent and desorbs the 3-ring sulfur compounds, which desorbent can be either in the liquid or vapor phase. If the regeneration is done in the vapor phase it can be accomplished by using hydrogen as the desorbent. The resulting sulfur-containing hydrogen stream can then be hydrodesulfurized, under conventional conditions, to remove the sulfur. The hydrogen need not be recycled.

The desorbent, which now carries the desorbed 3-ring sulfur compounds, leaves the adsorption zone via line 18 and is passed to distillation or fractionation zone 3 where the 3-ring sulfur compounds are separated from the desorbent. The difference in boiling point between the desorbed 3-ring sulfur compounds and the desorbent, of course, allows for separation of the two components by distillation. A stream concentrated in the 3-ring sulfur compounds is collected via line 20. The concentrate will typically be comprised of at least about 90 wt. % 3-ring polynuclear aromatic sulfur compounds. It is understood that this particular process scheme is for the case when the desorbent has a higher boiling point than the desorbed 3-ring sulfur compounds, which will most likely be the case. Of course, the process scheme would be different if the desorbent had a higher boiling point. In that case, the desorbent would exit fractionation zone 3 from the bottom and the 3-ring sulfur compound concentrate stream from the top. The distilled or fractionated desorbent is passed via line 16 to adsorption zone 2.

Having thus described the present invention, and preferred embodiments thereof, it is believed that the same will become even more apparent by the following examples. It will be appreciated, however, that the examples, as well as the figures hereof, are presented for illustration purposes and should not be construed as limiting the invention.

EXAMPLE 1

Various solids and adsorbents were contacted at 75° C. in sealed vials with a model hydrocarbon mixture which contained equal weights of dibenzothiophene (DBT) and 1-methyl naphthalene (1-MN) in a paraffinic solvent 2,2,4,4,6,6,8 heptamethyl nonane. The contacting was carried out with shaking for a period of 4 hours, which was long enough for the solid adsorbent and hydrocarbon phases to come to equilibrium. The hydrocarbon phase was analyzed by gas chromatography, before and after contacting with the adsorbent. From the analyses, calculations were made of the separation factor for DBT versus 1-MN, and the adsorbent capacity to adsorb DBT.

Separation factor is defined as $$\propto DBT/1-MN = \frac{[(DBT)/(1-MN)]_{in\ adsorbent}}{[(DBT)/(1-MN)]_{in\ solution}}$$

at equilibrium. Capacity is defined as weight percent DBT on adsorbent.

The following results were obtained:

| Factor Adsorbent Type | Adsorbent | Capacity, Weight % | Separation αDBT/1-MN |
|---|---|---|---|
| Activated Carbon | Filtrasorb 400 | 12 | 7.6 |

-continued

| Factor Adsorbent Type | Adsorbent | Capacity, Weight % | Separation αDBT/1-MN |
|---|---|---|---|
| Zeolites | ECR-17 | 6.5 | 3.5 |
| | LZ-210 | 7.4 | 2.2 |
| | NaY | 5.4 | 4.4 |
| | CSZ-1 | 6.4 | 1.2 |
| Supported CoMo | A | 2.8 | 3.9 |
| | B | 2.4 | 8.3 |
| | C | 1.4 | 7.4 |
| | D | 2.8 | 3.1 |
| Silica-Alumina | Davidson HA | 3.3 | 1.6 |

A = Catalyst designated HDS-22 from Criterion (15.5 wt. % $MoO_3$, 4.5 wt. % CoO).
B = CoMo on gamma alumina as described in U.S. Pat. No. 4,666,878 and containing 6 wt. % Mo and 3 wt. % Co on an elemental basis.
C = 20 wt. % $MoO_3$ on gamma alumina.
D = Catalyst designated KF-742 from AKZO and containing 14.9 wt. % $MoO_3$ and 4 wt. % CoO.
Davidson HA is a high alumina (about 25 wt. %) silica-alumina material.
Filtrasorb 400, an activated carbon available from Calgon Corp. and having a high fraction of pores in the 20–100 Angstrom range.

These results show that certain zeolites, activated carbon, supported CoMo sorbents, and high alumina/silica-alumina will preferentially adsorb dibenzothiophene in preference to 1-methyl naphthalene. The activated carbon has the most attractive combination of separation factor and capacity.

EXAMPLE 2

Figure 2:
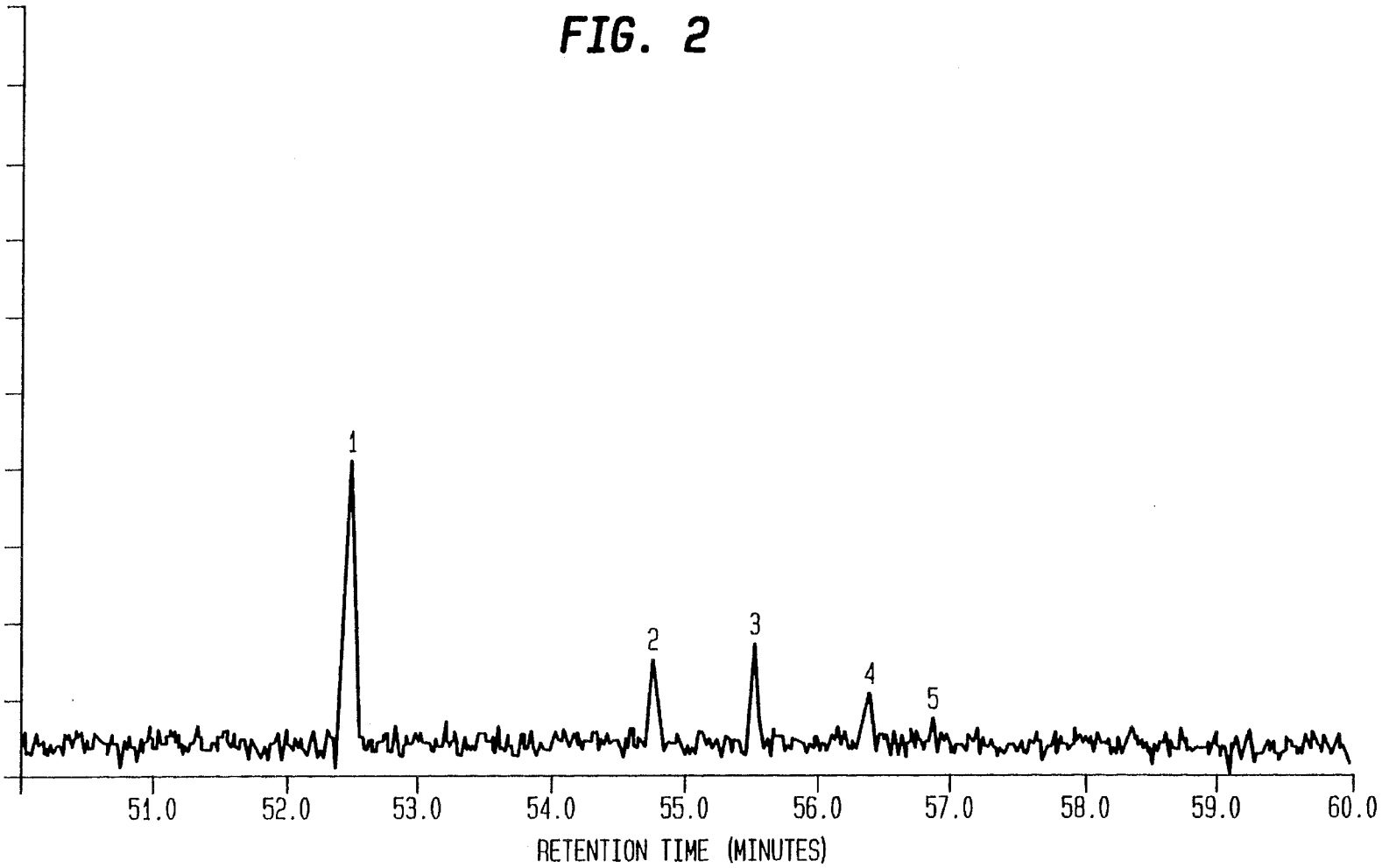
FIG. 2 is a sulfur-specific gas chromatograph of the feedstock used in Example 2 showing relative peaks in milivolts as a function of retention time.
Figure 3:
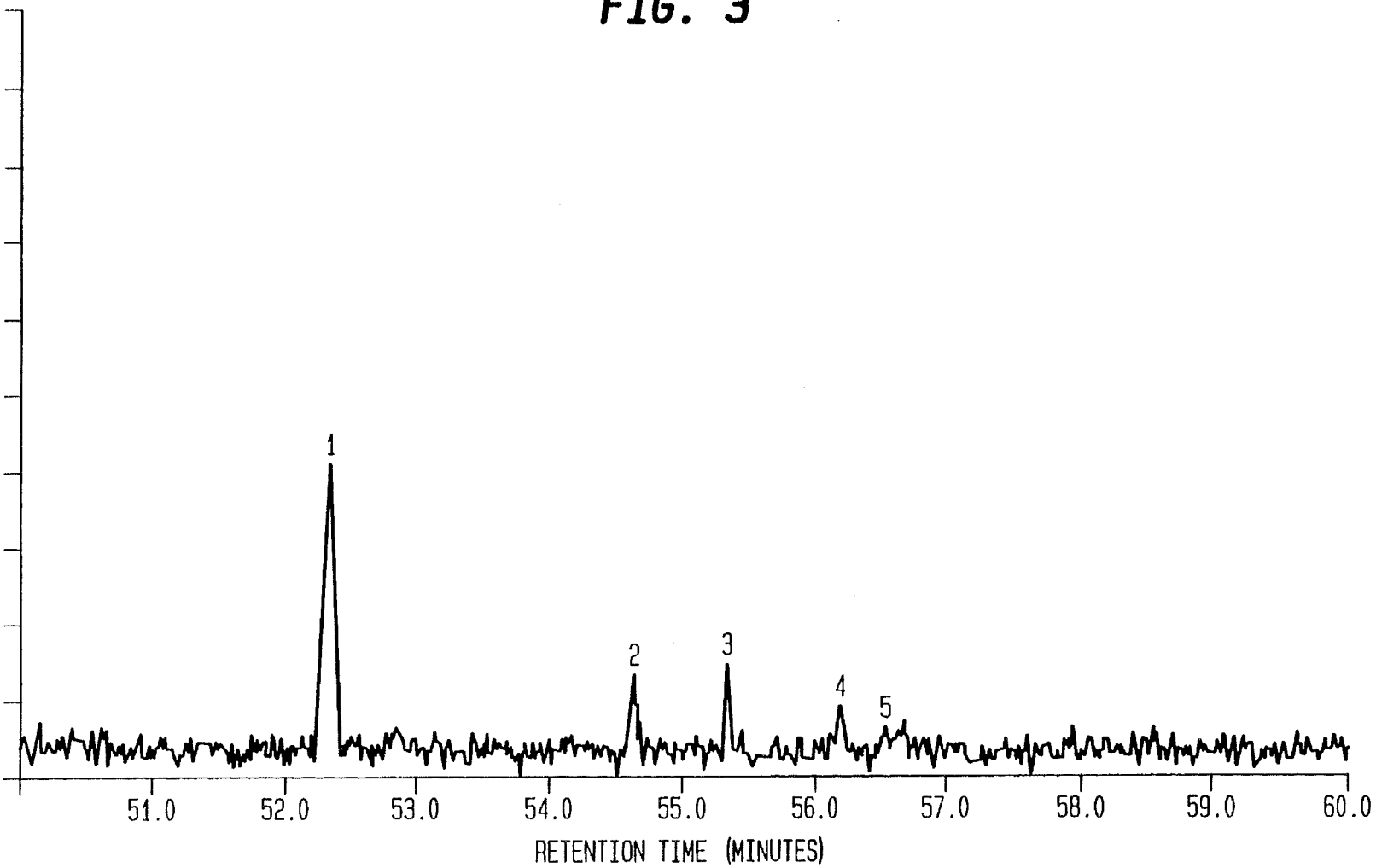
FIG. 3 is a sulfur-specific gas chromatograph of the feedstock used in Example 2 after being passed over copper Y zeolite as an adsorbent.
Figure 4:
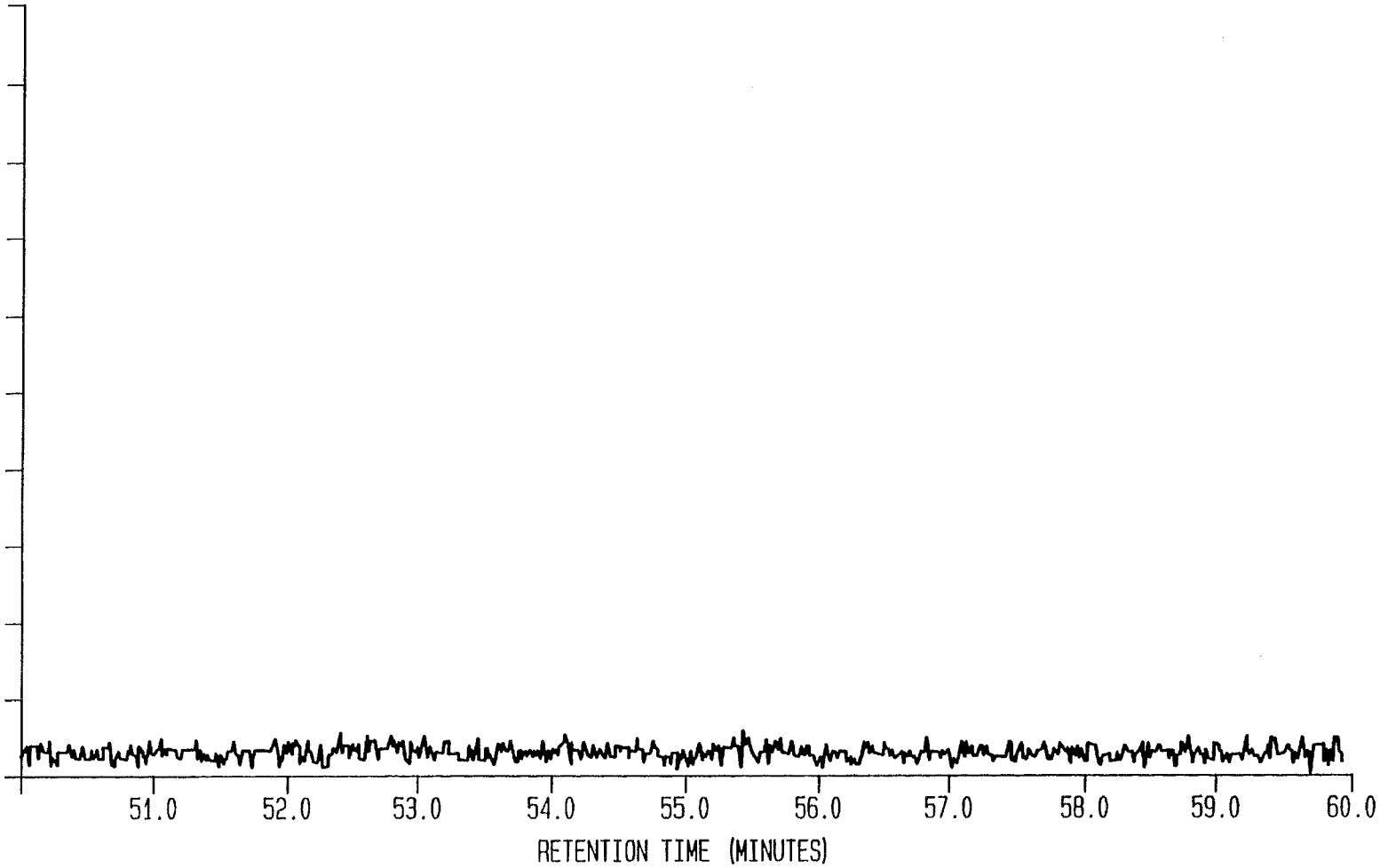
FIG. 4 is a sulfur-specific gas chromatograph of the feedstock of Example 2 after being passed over Filtrasorb 400 activated carbon as the adsorbent.

The experiment of Example I was repeated using a refinery diesel stream in place of the model hydrocarbon mixture. This stream was a severely hydrotreated virgin mid-distillate stream containing 390 ppm total sulfur, most of which was hard sulfur. FIG. 2 shows a sulfur-specific gas chromatograph of the feed which shows five peaks. The gas chromatograph used was a flame photometric detector type in which split injection of a 1 ml sample was used at a temperature program of 70° C. to 325° C. at 4° C./min and an injector temperature of 350° C. The greatest peak corresponds to 4,6 dimethyl DBT. The others correspond to other sterically hindered ethyl methyl and trimethyl DBTs. These "hard sulfur" compounds have common characteristics: they all have three rings and are highly substitutioned at positions adjacent to the sulfur atoms, i.e., di-beta-substituted structures. Conventional sulfur traps do not adsorb these molecules owing to the steric hindrance. The size of these 3-ring molecules also plays an important role. For instance, it has recently been shown that a copper Y zeolite is effective for separating thiophene from benzene, but when we contacted this material with the severely hydrotreated virgin mid-distillate, no additional sulfur removal was observed, as shown in FIG. 3 hereof. However, with Filtrasorb 400 activated carbon adsorbent, the removal of hard sulfur is essentially complete, within the detection limits, as shown in FIG. 4.

EXAMPLE 3

In this example, a middle distillate hydrotreated stream was passed through an adsorption column packed with granules of activated carbon (Filtrasorb 400). The hydrotreated mid-distillate stream fed to the column contained 1200 ppm sulfur. The column was a 1-inch internal diameter pipe, 25 inches long. The hydrocarbon stream flow was varied in the range of 10 to 20 cc/minute. Column temperature was 100° C. Feed was pumped continuously through the column, and effluent samples were taken as a function of time and analyzed for sulfur (total and type distribution). When the column became saturated with sulfur compounds, the feed was shut off and a toluene desorbent was passed through the column at 100° C. After the column was purged of sulfur compounds, a second adsorption cycle was run.

Figure 5:
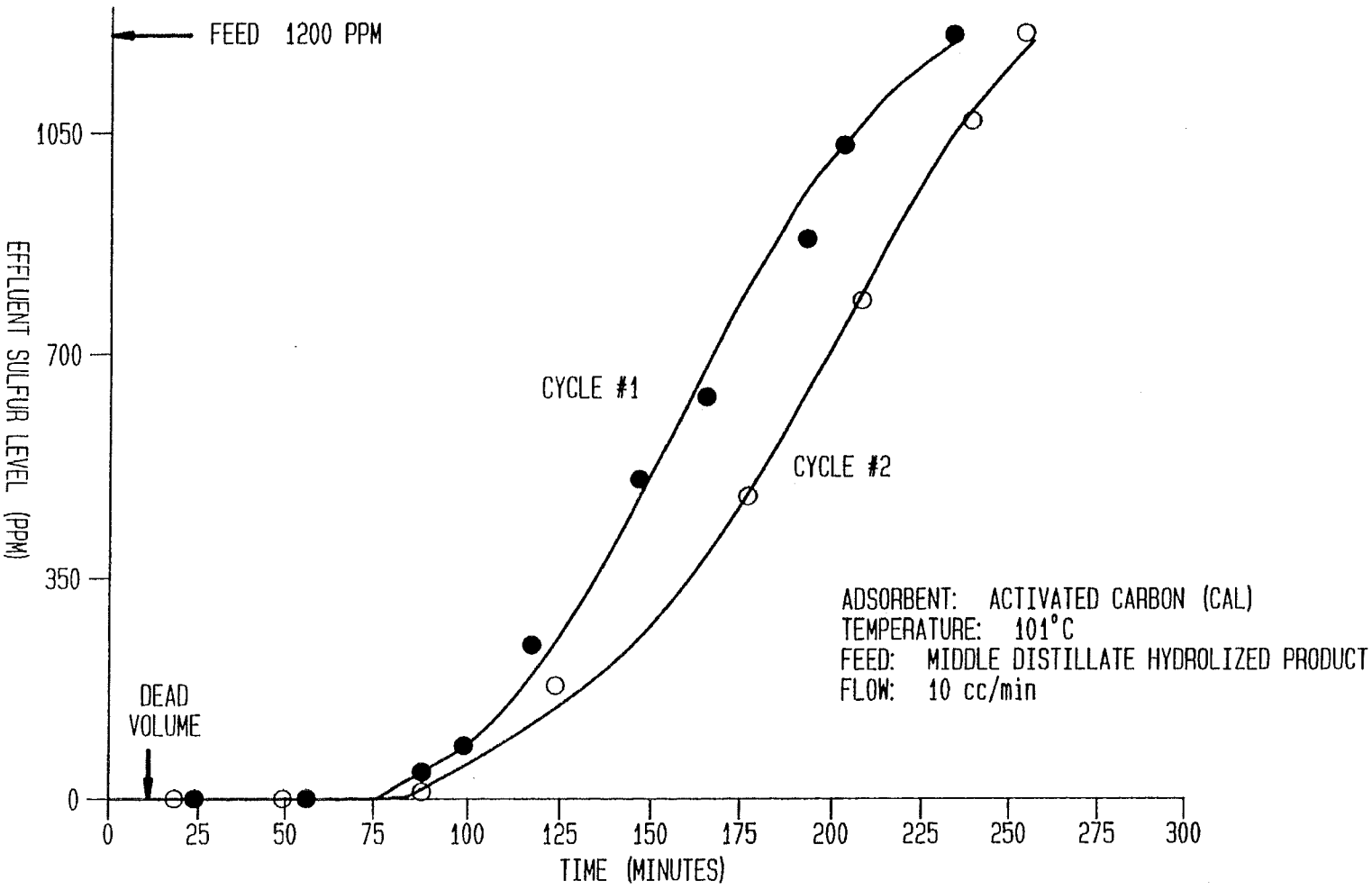
FIG. 5 is a graph of effluent sulfur level versus time for two cycles of adsorption using activated carbon as the adsorbent in accordance with Example 3.

As illustrated in FIG. 5 hereof, the carbon adsorbent removed essentially all of the sulfur for the first 75 minutes. Sulfur in the treated mid-distillate stream was below the limit of detection of about 25 ppm. Sulfur broke through the column in increasing effluent concentration over the time interval 75 to 225 minutes. After regeneration with a toluene wash, a second adsorption cycle (cycle #2) was run. The sulfur breakthrough curve for cycle #2 was similar to that for cycle #1, showing that toluene is an effective desorbent.

Figure 6:
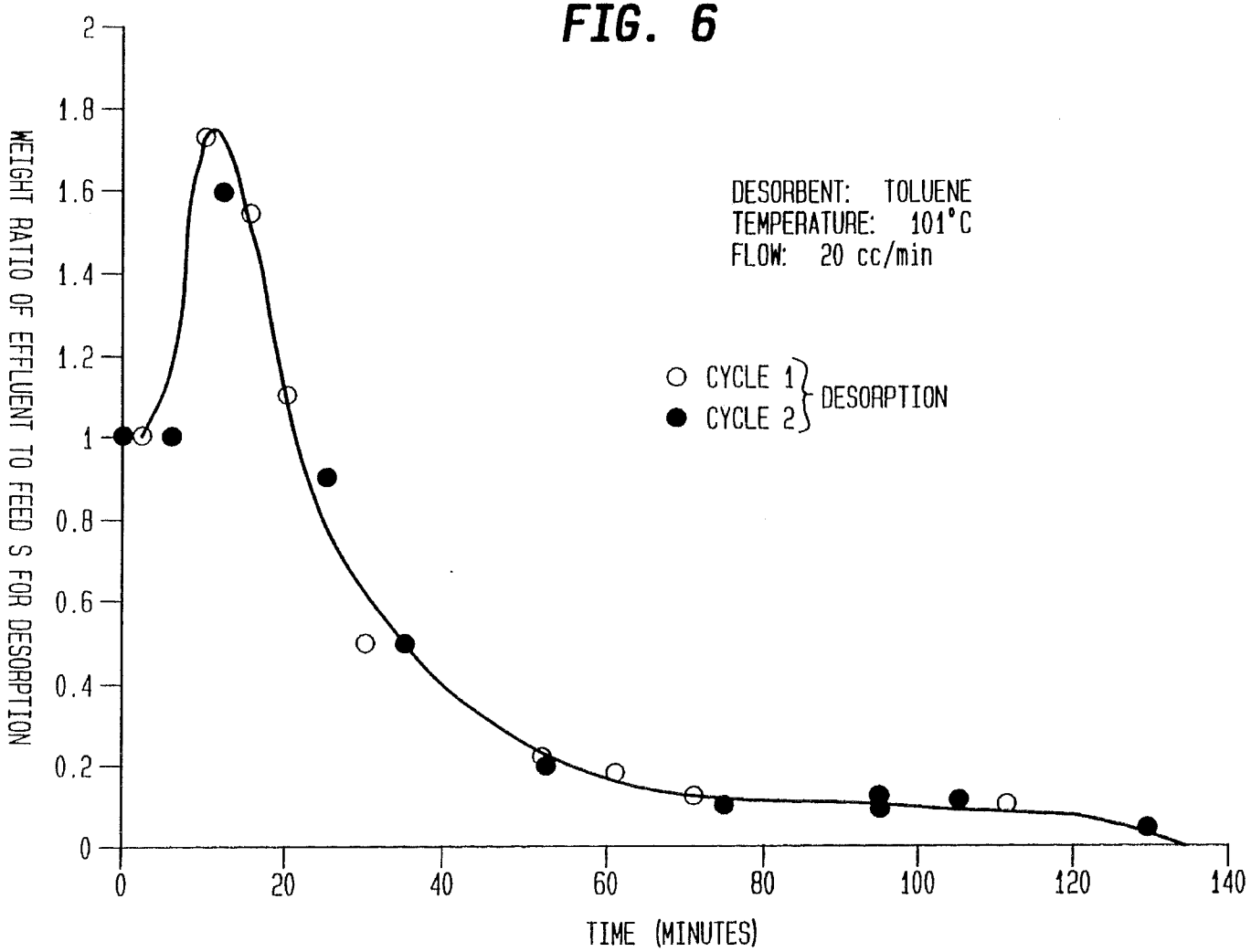
FIG. 6 is a graph of the ratio of effluent to feed sulfur for desorption versus time for toluene as the desorbent and activated carbon as the adsorbent in accordance with Example 3.

FIG. 6 hereof shows that toluene effectively regenerates the activated carbon by desorbing the hard sulfurs, thereby allowing repeated adsorption/desorption cycles.

What is claimed is:

1. A process for removing substantially all of the sulfur from a distillate stream, which process comprises:

(a) hydrotreating the stream at conditions which include the presence of hydrogen, temperatures within the range of 200° to 425° C., and a catalyst comprised of at least one Group VIII metal and one Group VI metal, on an inorganic support;

(b) passing the hydrotreated distillate stream to an adsorption zone containing a solid adsorbent which adsorbs beta and di-beta-substituted dibenzothiophene aromatic sulfur compounds, which adsorbent is activated carbon having a surface area in the range of about 800 to 1200 $m^2/g$ and with at least 30% of the pore volume being greater than 20 Å;

(c) collecting the resulting substantially sulfur free distillate stream; and (d) regenerating the adsorbent by passing a liquid or vapor desorbent, selected from steam, toluene, xylene, and a mixture of toluene and xylene thereof, through the bed of adsorbent in the adsorption zone, thereby removing the beta and di-beta-substituted dibenzothiophene sulfur compounds from the adsorbent;

(e) passing the beta and di-beta-substituted dibenzothiophene sulfur compound-containing desorbent to a distillation zone to separate said sulfur compounds from the desorbent, thereby resulting in a stream rich in beta and di-beta-substituted dibenzothiophene sulfur compounds and a desorbent stream; and (f) recycling the desorbent stream back to the adsorption zone.

2. The process of claim 1 wherein the desorbent is toluene.

3. The process of claim 1 wherein the contacting of the distillate stream with the solid adsorbent is carried out in fixed beds, moving beds, fluidized beds, simulated moving beds and magnetically-stabilized beds.

* * * * *